US008702133B2

(12) United States Patent
Sun et al.

(10) Patent No.: US 8,702,133 B2
(45) Date of Patent: Apr. 22, 2014

(54) BI-STABLE ACTUATOR FOR ELECTRONIC LOCK

(75) Inventors: Fanping Sun, Glastonbury, CT (US); Zaffir A. Chaudhry, South Glastonbury, CT (US); Ulf J. Jonsson, South Windsor, CT (US); John M. Milton-Benoit, West Suffield, CT (US); Kitty P. Liu, Waterbury, CT (US)

(73) Assignee: UTC Fire & Security Corporation, Farmington, CT (US)

( * ) Notice: Subject to any disclaimer, the term of this patent is extended or adjusted under 35 U.S.C. 154(b) by 456 days.

(21) Appl. No.: 12/998,625

(22) PCT Filed: Dec. 2, 2008

(86) PCT No.: PCT/US2008/013287

§ 371 (c)(1),
(2), (4) Date: May 10, 2011

(87) PCT Pub. No.: WO2010/065013

PCT Pub. Date: Jun. 10, 2010

(65) Prior Publication Data

US 2011/0210564 A1 Sep. 1, 2011

(51) Int. Cl.
*E05C 17/56* (2006.01)
*E05B 1/00* (2006.01)

(52) U.S. Cl.
USPC ..... 292/251.5; 292/347; 70/224

(58) Field of Classification Search
USPC ..... 292/251.5, 347; 70/224; 335/229
See application file for complete search history.

(56) References Cited

U.S. PATENT DOCUMENTS

| | | | | | |
|---|---|---|---|---|---|
| 2,446,336 | A | * | 8/1948 | Mark et al. | 49/395 |
| 3,376,615 | A | * | 4/1968 | Heckman | 24/303 |
| 3,468,576 | A | * | 9/1969 | Beyer et al. | 292/251.5 |
| 3,790,197 | A | * | 2/1974 | Parker | 292/251.5 |
| 4,367,449 | A | * | 1/1983 | Veisz et al. | 335/229 |
| 4,832,385 | A | * | 5/1989 | Llort | 292/144 |
| 4,912,460 | A | | 3/1990 | Chu | |
| 5,434,549 | A | * | 7/1995 | Hirabayashi et al. | 335/229 |
| 5,719,451 | A | | 2/1998 | Cook et al. | |
| 5,823,026 | A | | 10/1998 | Finke | |
| 6,040,752 | A | * | 3/2000 | Fisher | 335/234 |
| 6,084,320 | A | * | 7/2000 | Morita et al. | 310/12.33 |
| 6,310,411 | B1 | * | 10/2001 | Viallet | 307/125 |
| 6,501,357 | B2 | | 12/2002 | Petro | |
| 6,765,330 | B2 | * | 7/2004 | Baur | 310/103 |
| 6,836,201 | B1 | * | 12/2004 | Devenyi et al. | 335/229 |
| 6,865,916 | B2 | | 3/2005 | Goldman | |
| 6,983,923 | B2 | * | 1/2006 | Fukui et al. | 251/65 |

(Continued)

FOREIGN PATENT DOCUMENTS

| | | | | | |
|---|---|---|---|---|---|
| JP | 54102046 | A | * | 8/1979 | E05C 19/16 |
| JP | 05340149 | A | * | 12/1993 | E05C 1/16 |

*Primary Examiner* — Carlos Lugo
(74) *Attorney, Agent, or Firm* — Cantor Colburn LLP

(57) ABSTRACT

An actuator for an electronic door lock includes a stationary first magnet assembly, a beam, and a second magnet assembly. The first magnet includes at least one magnet stationarily positioned within the electronic door lock. The beam is movable relative to the first magnet assembly to a first position and a second position. The second magnet assembly is connected to the beam and is configured to be magnetically repulsed away from the first magnet assembly. The repulsion of the second magnet assembly maintains the beam in either the first or second position until the beam is selectively actuated therefrom.

22 Claims, 5 Drawing Sheets

(56) References Cited

U.S. PATENT DOCUMENTS

| | | | | |
|---|---|---|---|---|
| 7,196,602 | B2 * | 3/2007 | Adams et al. | 335/264 |
| 7,267,378 | B2 * | 9/2007 | Drumm | 292/251.5 |
| 7,439,641 | B2 * | 10/2008 | Ogino et al. | 310/15 |
| 7,516,633 | B1 * | 4/2009 | Chang | 70/472 |
| 7,589,608 | B2 * | 9/2009 | Decker et al. | 335/229 |
| 7,710,226 | B2 * | 5/2010 | Nelson | 335/229 |
| 7,942,458 | B2 * | 5/2011 | Patterson | 292/251.5 |
| 2005/0050929 | A1 | 3/2005 | Meyerle | |
| 2005/0183480 | A1 | 8/2005 | Hingston et al. | |
| 2007/0176437 | A1 | 8/2007 | Marschalek et al. | |
| 2008/0272606 | A1 * | 11/2008 | Alacqua et al. | 292/38 |

* cited by examiner

BI-STABLE ACTUATOR FOR ELECTRONIC LOCK

BACKGROUND

The present invention relates to a door lock, and more particularly to an actuator for an electronic door lock.

Electronic door locks typically include a mechanical lock and an electronic control for authorizing the use of the mechanical lock. A portion of the mechanical lock secures the door to the door frame. The electronic control may include, for example, a reader that permits data to be read from a coded medium such as a magnetic card, proximity card, or memory key. When a card or key with valid data is presented to the electronic control, the control permits an outer handle or door knob to operate a shaft of the mechanical lock by actuating a prime mover to either release a latch that was preventing the handle or knob from turning, or engage a clutch that couples a shaft of the handle or knob to the shaft of the mechanical lock.

The mechanical lock and electronic control components (including the prime mover and latch/clutch) of electronic door locks are commonly powered by alkaline batteries which typically have a service life of between about two to three years. This limited battery service life necessitates changing the batteries several times over the service life of the door lock; a process that increases the operating costs of businesses which employ the electrical locks. Many electronic locks utilize a piezoelectric bender as the prime mover to actuate the clutch or latch. Electronic door locks used in certain commercial and hospitality applications are commonly cycled between an office or free passage mode (used during the work day or peak traffic periods to permit entry through the door without the user first presenting a card or key to the reader), and a challenge mode which requires the user to present the card or key to the reader to gain entry through the door. To permit unchallenged entry through the door in the office mode, a conventional electronic door lock uses energy from the batteries to activate and maintain the engagement of the piezoelectric bender with the clutch. This energy drain reduces the service life of the batteries.

SUMMARY

An actuator for an electronic door lock includes a stationary first magnet assembly, a beam, and a second magnet assembly. The first magnet includes at least one magnet stationarily positioned within the electronic door lock. The beam is movable relative to the first magnet assembly to a first position and a second position. The second magnet assembly is connected to the beam and is configured to be magnetically repulsed away from the first magnet assembly. The repulsion of the second magnet assembly maintains the beam in either the first or second position until the beam is selectively actuated therefrom.

DETAILED DESCRIPTION

Figure 1:
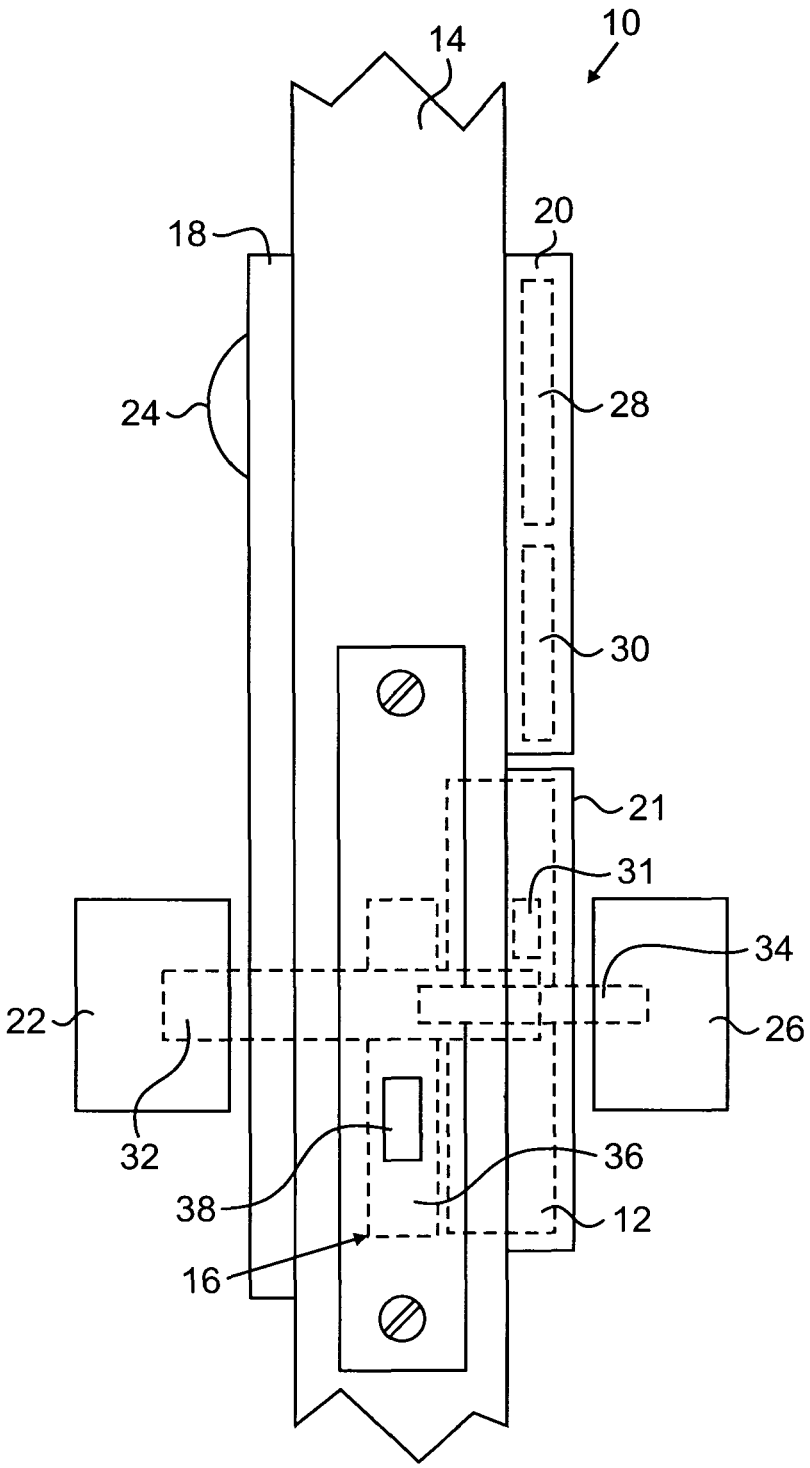
FIG. 1 is a schematic view an electronic door lock including a low energy piezoelectric actuator.

FIG. 1 is a schematic view of an electronic door lock 10 including a low energy clutch 12. The door lock 10 is disposed in a door 14. The door lock 10 includes a latch mechanism 16, an outer escutcheon 18, an inner escutcheon 20, and an inner rosette 21. The outer escutcheon 18 includes an outer handle or knob 22 and a reader 24. The inner rosette 21 connects to the inner handle or knob 26. The inner escutcheon 20 has a control circuit 28, and batteries 30. Additionally, the door lock 10 includes an actuator 31, a handle shaft 32 and a lock shaft 34. The latch mechanism 16 includes a body 36 and a bolt and/or latch 38.

The electronic lock 10 extends through the door 14 between an interior side and an outer side thereof. The door 14 can be part of a vehicle or part of a residential/commercial/hospitality structure. The clutch 12, latch mechanism 16, outer escutcheon 18, and inner escutcheon 20, can be partially housed within a mortise in the door 14. The electronic lock 10 includes the outer escutcheon 18 which extends from the outer side of the door 14, and the inner escutcheon 20 and inner rosette 21 which extend from the interior side of the door 14.

The outer escutcheon 18 is adapted with the reader 24 to receive a coded medium such as a magnetic card, proximity card, or memory key. The outer handle 22 rotatably projects from the lower portion of the outer escutcheon 18. Interfacing a portion of the outer escutcheon 18 on the interior portion of the door 14 is the inner escutcheon 20. The inner escutcheon 20 houses the control circuit 28 and batteries 30 therein. The inner handle 26 rotatably connects through the rosette 21 to the lock shaft 34 which is rotatably mounted to extend through the rosette 21 into the clutch 12. In one embodiment, the rosette 21 houses the actuator 31 which selectively connects to the clutch 12. The actuator 31 is a beam with one or more magnets and can be actuated, for example, by piezoelectric, electrostatics, or electromagnetically. The lock shaft 34 connects to the body 36 of the latch mechanism 16. The body 36 actuates or allows the latch and/or bolt 38 to be actuated out of a door frame (not shown) when unlocked. When the latch mechanism 16 is locked, the body 36 retains the latch 38 in the door frame. The clutch 12 selectively couples the lock shaft 34 with the handle shaft 32 when actuated by the actuator 31. The handle shaft 32 is rotatably mounted in the outer escutcheon 18 and extends therethrough to connect with the outer handle 22.

When the electronic lock 10 (and hence the latch mechanism 16) is in a locked state, the handle shaft 32 can be rotatably actuated by the user's depressing or rotating the outer handle 22. However, the rotation of the handle shaft 32 is independent of the lock shaft 34 which is disposed adjacent to, and is not in contact with, the handle shaft 32. Thus, the latch mechanism 16 does not respond to the user's rotation of the outer handle 22 and the electronic lock 10 remains locked.

The reader 24 is electrically connected to the control circuit 28 which can be activated to supply power through wiring to the actuator 31 adjacent the clutch 12. The batteries 30 also provide power for the components of the electronic lock 10 including the reader 24, control circuit 28, and can supply power to the clutch 12.

When the control circuit 28 is programmed for an office or free passage mode, the latch mechanism 16 for the electronic door lock 10 enters (and is maintained in) an unlocked state, allowing the user to swing the door 14 open without first having to present a valid key card (or other coded medium) to the reader 24. More particularly, as the control circuit 28 initially enters the office mode, the control circuit 28 piezoelectrically, electrostatically, or electromagnetically actuates a movable beam of the actuator 31 to move the beam from a first position, in which the beam is disengaged from or does not engage the clutch 12 sufficiently to couple it between the shafts 32 and 34, to a second position, in which the beam engages and moves the clutch 12 to couple the lock shaft 34 with the handle shaft 32. The coupling of the shafts 32 and 34 via the clutch 12 allows the shafts 32 and 34 to be rotated together to unlock the latch mechanism 16.

Once in the first or second position, the actuator 31 can be electrically or magnetically deactivated yet the beam can be maintained in either position by one or more magnet(s) which are oriented around the beam and one or more magnet(s) arranged on the beam so as to exert a force (generated by magnetic repulsion of the magnets) on the beam and thereby deflect and hold the beam in the first or second position. In one embodiment, the magnetic repulsion is sufficient to overcome a bias force on the clutch 12 which attempts to disengage the clutch 12 from coupling engagement between the shafts 32 and 34. In this manner the beam is magnetically maintained in the second engaged position while the electronic door lock 10 is in the office mode or is maintained in the first locked position.

For the electronic lock 10 and latch mechanism 16 to enter the unlocked state when the control circuit 28 is programmed for a challenge mode, a valid key card (or other coded medium) must first be presented to the reader 24 by the user. The reader 24 signals the control circuit 28 which electrically or magnetically actuates the beam of the actuator 31 to temporarily move the beam from the first locked position to the second engaged position. In the second engaged position, the beam temporarily engages and moves the clutch 12 between the shafts 32 and 34 to couple the shafts 32 and 34 together.

After the user to swings the door 14 open, a sufficient period of time has elapsed since the key card was presented to the reader 24 by the user, or some other condition precedent occurs, the control circuit 28 actuates the beam back to the first locked position from the second engaged position thereby decoupling the shafts 32 and 34 and locking the latch mechanism 16. In both the office mode and challenge mode, the actuation of the beam to and from the first locked position and second engaged position overcomes the magnetic repulsion holding the beam of the actuator 31 in both positions.

Because no energy from the batteries 30 is required to hold the beam in the first position or the second position in either the office mode or the challenge mode, the actuator 31 draws very small amounts of power from the batteries 30. Human (user) torque can also be used to rotate the handle shaft 32 and lock shaft 34 after the shafts 32 and 34 are coupled by the clutch 12 in addition to (or in place of) a drive assembly powered by the batteries 30. The reduced draw on the batteries 30 during operation increases the service life of the batteries 30, and thereby, decreases the operating costs associated with replacement of the batteries 30.

The configuration of the electronic lock shown in FIG. 1 is exemplary, and therefore, neither the arrangement of the lock components nor the type of components illustrated are intended to be in any way limiting. FIG. 1 simply illustrates an embodiment of an electronic lock that would benefit from the low energy clutch disclosed herein. In another embodiment, the actuator could be adapted to release a latch that was preventing the outer handle and handle shaft from turning in the second position to allow the electronic door lock to be unlocked and the door opened by the user.

Figure 2A:
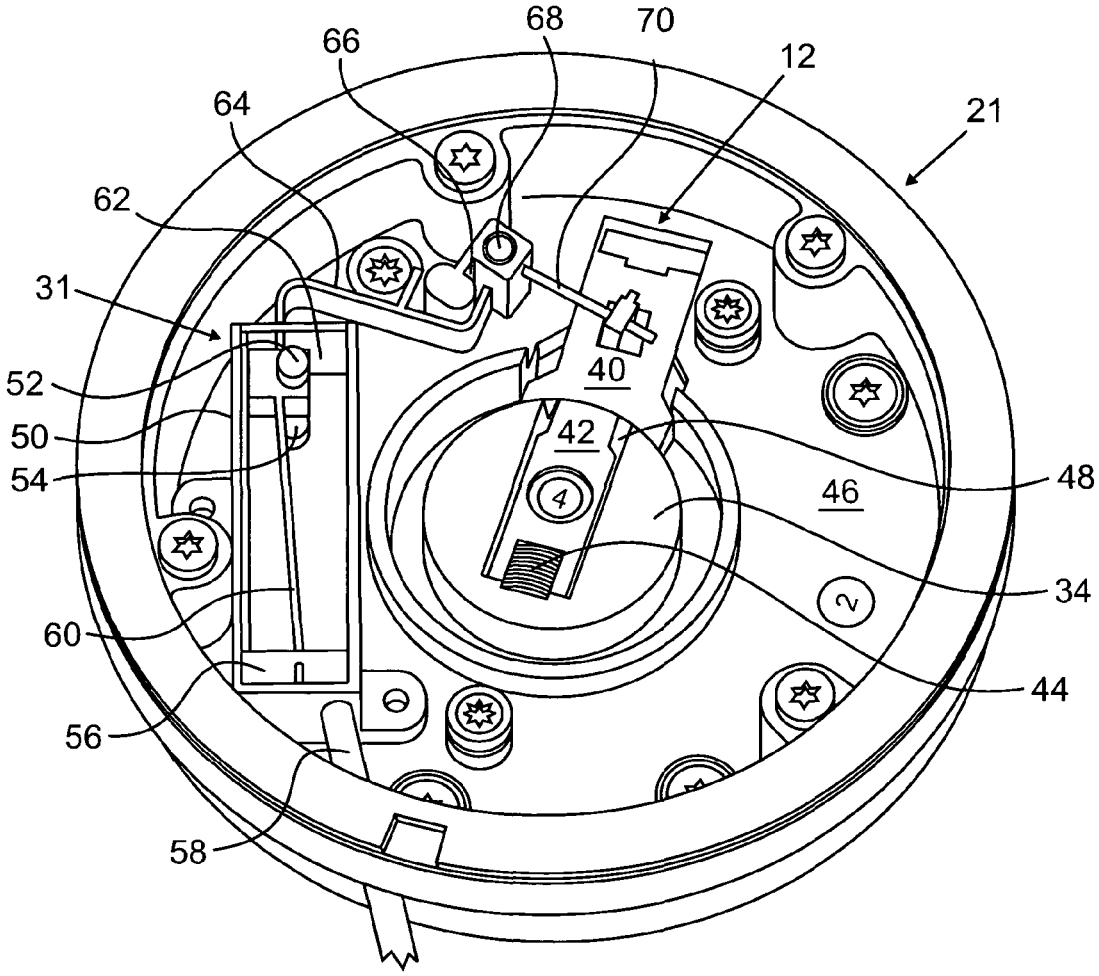
FIG. 2A is a perspective view of one embodiment of the actuator and a clutch disposed in a portion of the door lock with the clutch in a locked position.
Figure 2B:
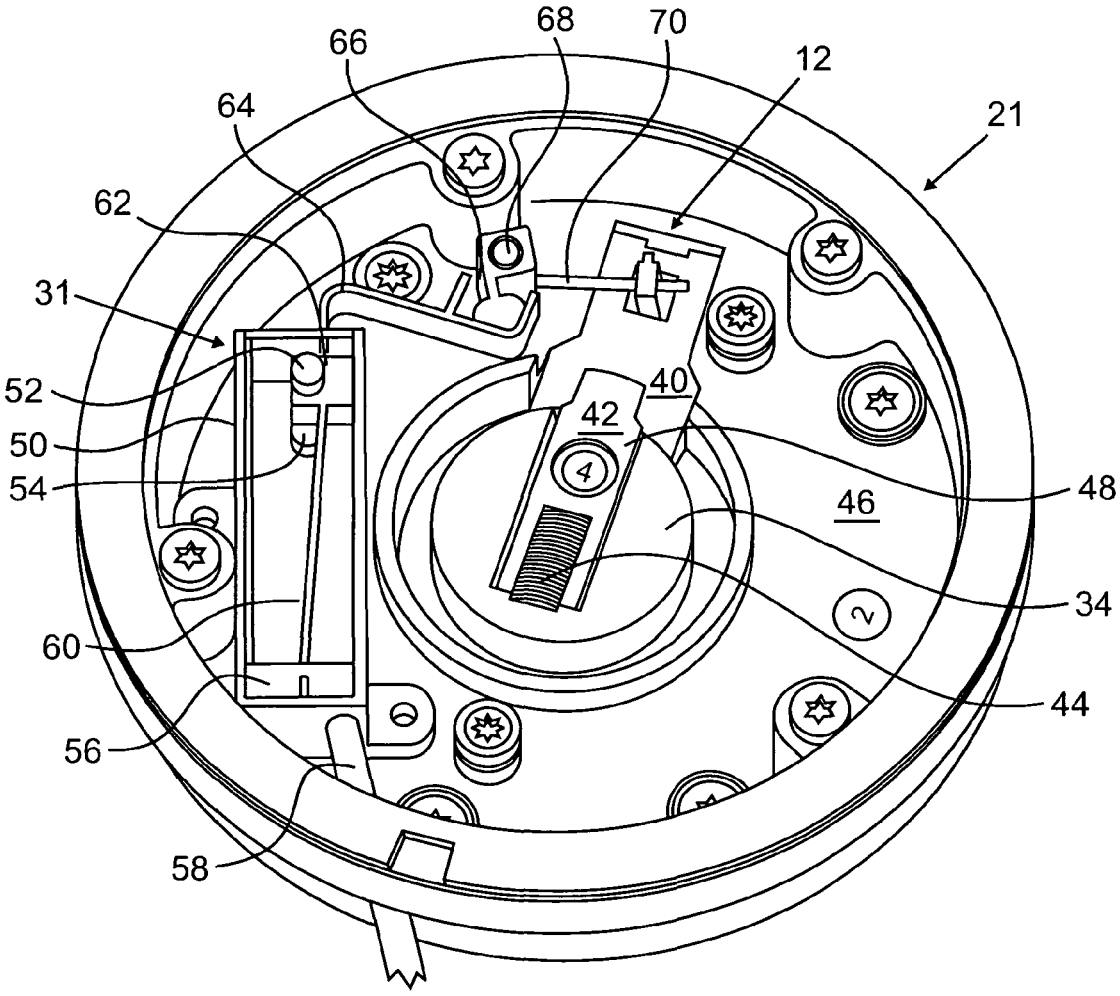
FIG. 2B is a perspective view of the actuator and clutch of FIG. 2A with the clutch in an unlocked position.

FIG. 2A is a perspective view of one embodiment of the actuator 31 and clutch 12 disposed in the rosette 21 with the clutch 12 in the first locked position. FIG. 2B is a view of the actuator 31 and clutch 12 of FIG. 2A with the clutch 12 in the second unlocked position. The clutch 12 includes a pawl 40, a plunger 42, and a bias spring 44. The rosette 21 includes a mounting plate 46. The lock shaft 34 includes a blind hole 48. The actuator 31 includes a frame 50, a first magnet 52, a second magnet 54, a mounting plate 56, wiring 58, the beam 60, a third magnet 62, a first linkage 64, a pivot arm 66, a pivot pin 68, and a second linkage 70.

In FIGS. 2A and 2B, the handle shaft 32 has been removed to better illustrate the components of the clutch 12. In the embodiment shown, the handle shaft 32 is co-axially aligned with and rotatably mounted adjacent the lock shaft 34. The handle shaft 32 has a cavity (not shown) which rotatably receives an end portion of the lock shaft 34 therein. The pawl 40 is disposed adjacent an end of the handle shaft 32. A slot, blind hole or camming surface (not shown) within the cavity in the handle shaft 32 selectively receives the plunger 42 portion of the clutch 12 when the plunger 42 is not engaged by the pawl 40. The rotatable lock shaft 34 houses the plunger 42 and bias spring 44. More particularly, the plunger 42 and bias spring 44 are movably received in the blind hole 48 in the lock shaft 34. The mounting plate 46 surrounds the lock shaft 34 and receives the pawl 40. The pawl 40 is selectively engaged by the actuator 31 to move within the mounting plate 46 to engage the plunger 42.

The hollow generally rectangular frame 50 of the actuator 31 is mounted to the mounting plate 46 adjacent the handle shaft 32 and lock shaft 34. Sidewalls of the frame 50 have been removed to illustrate components of the actuator 31. The first and second magnets 52 and 54 are fixedly connected to the sidewalls (not shown). The mounting plate 56 is connected to a lower end portion of the frame 50. The mounting plate 56 receives the beam 60. The frame 50 is adapted to receive wiring 58 which electrically connects to the beam 60 (which can be a piezoelectric, electrostatic, or an electromagnet assembly). The beam 60 extends within the frame 50 and is movable between the first and second magnets 52 and 54. The third magnet 62 is mounted to the beam 60 adjacent the first and second magnets 52 and 54 such that the third magnet 62 is movable between the first and second magnets 52 and 54 along with the beam 60. The beam 60 connects to the first linkage 64 which extends generally laterally away from the frame 50 to connect to the pivot arm 66. The pivot arm 68 rotates about the pivot pin 70 which is secured to the mounting plate 56. The pivot arm 68 connects to the second linkage 70. The second linkage 70 selectively engages the pawl 40 portion of the clutch 12 to move the pawl 40 into engagement with the plunger 42.

In FIG. 2A, the actuator 31 does not engage the pawl 40 portion of the clutch 12. Therefore, the pawl 40 is biased (by a spring or other means not shown) into engagement with the plunger 42 portion of the clutch 12. The engagement of the pawl 40 with the plunger 42 overcomes the bias of the bias spring 44 to force the plunger 42 downward into the blind hole 48. The engagement of the pawl 40 with the plunger 42 also disengages the plunger 42 from the slot or blind hole in the lock shaft 32 (not shown) thereby decoupling the shafts 32 and 34 from one another.

As illustrated in FIG. 2A, the magnetic repulsion of the third magnet 62 from the first and second magnets 52 and 54 deflects and holds the beam 60 in the first position. More particularly, the magnetic repulsion of the third magnet 62 from the first and second magnets 52 and 54 deflects the beam 60 generally away from the lock shaft 34 thereby causing the first linkage 64 to pivot the pivot arm 66 generally toward the frame 50. With the pivot arm 66 pivoted in this manner, the second linkage 70 is disengaged from (or does not engage the pawl 40 with sufficient force to overcome the bias on the pawl 40) the pawl 40 which is biased downward into engagement with the plunger 42.

When current is supplied through the wiring 58 to the beam 60 the beam 60 which is illustrated as a piezoelectric assembly mechanically deflects. The deflection of the beam 60 overcomes the magnetic repulsion of the third magnet 62 from the first and second magnets 52 and 54 and the beam 60 moves between the first and second magnets 52 and 54 from the first position of FIG. 2A to the second position illustrated in FIG. 2B. More specifically, the movement of the beam 60 generally toward the lock shaft 34 moves the first linkage 64 to pivot the pivot arm 66 generally toward the pawl 40. The rotation of the pivot arm 66 engages the second linkage 70 with the pawl 40 thereby overcoming the bias on the pawl 40 and moving the pawl 40 outward away from the plunger 42. The outward movement of the pawl 40 away from the plunger 42 allows the bias spring 44 to bias the plunger 42 outward from the lock shaft 34 into the slot or blind hole in the lock shaft 32 (not shown) thereby coupling the shafts 32 and 34 together. In one embodiment, the polarity of the current applied to the beam 60 or electro-magnet assembly (not shown) can be reversed to move the beam 60 back between the first and second magnets 52 and 54 from the second position (FIG. 2B) to the first position (FIG. 2A). In this manner the movement of the beam 60 from the first position to the second position is reversible to lock and unlock the latch mechanism 16 (FIG. 1).

When the beam 60 is in either the first position or the second position (the second position would be utilized if the electronic lock 10 is in the office mode setting), the magnetic repulsion of the third magnet 62 from the first and second magnets 52 and 54 maintains or mechanically stabilizes the beam 60 in the deflected position without current having to be applied from the batteries 30 (FIG. 1). Thus, power need only be drawn from the batteries 30 (FIG. 1) when the beam 60 is actuated from the first position to the second position (or visa versa). The configuration and arrangement of the actuator 31 and clutch 12 shown in FIGS. 2A and 2B merely represent one embodiment of these components, therefore, the components shown are exemplary. In another embodiment, the frame of actuator 31 can be generally cylindrical in shape and can be mounted inside the inner door handle, outer door handle, handle shaft, or lock shaft.

Figure 3A:
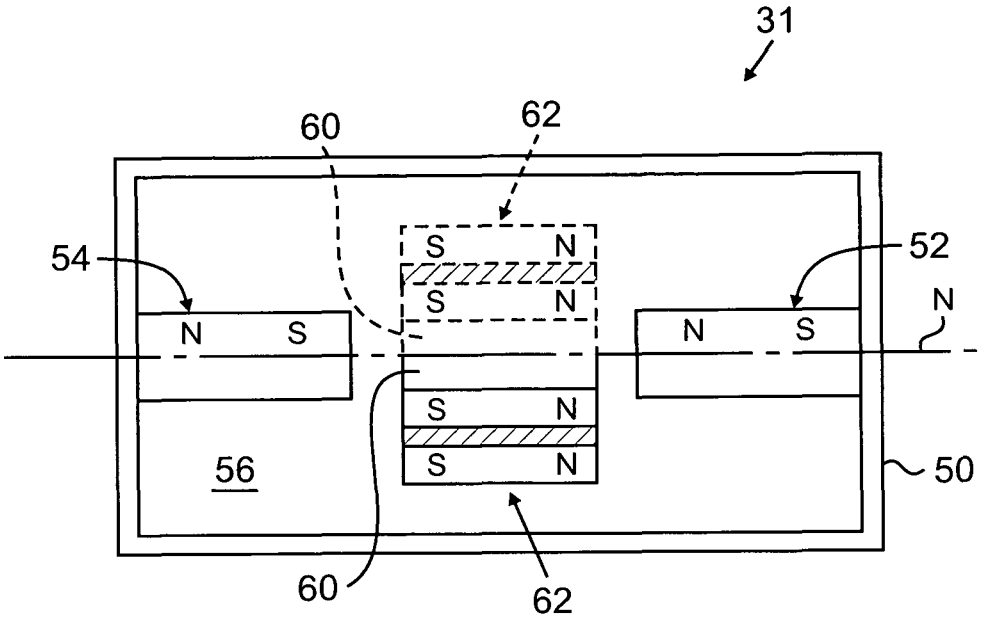
FIG. 3A is a schematic end view of one embodiment of magnets used in the actuator.

FIG. 3A is an end view of the actuator 31 illustrating one arrangement of the magnets 52, 54 and 62 including the orientation of poles of each magnet 52, 54 and 62. FIG. 3A illustrates the beam 60 magnetically deflected to the first locked position and the second unlocked position (indicated with dashed lines).

In one embodiment the actuator 31 includes the hollow generally rectangular frame 50 which connects to the first and second magnets 52 and 54 and extends around the beam 60. The beam 60 extends through an open end of the frame 50 to connect to the first linkage 64 (FIGS. 2A and 2B). A lower end of the frame 50 connects to the mounting plate 56 which receives the beam 60. The first and second magnets 52 and 54 generally interface one another from opposing sidewalls of the frame 50 and are generally aligned along a mechanical neutral axis N of the beam 60. More particularly, the portion of the beam 60 which connects to the mounting plate 56 aligns generally with the mechanical neutral axis N. In either the first position or the second position, the beam 60 is deflected along its length such that the portion of the beam 60 which the third magnet 62 is mounted around is disposed at a distance from the neutral axis N. More particularly, the beam 60 is deflected into either the first position or the second position by the magnetic repulsion of the third magnet 62 from the first and second magnets 52 and 54. When the beam 60 is actuated from the first position to the second position (or visa versa), the beam 60 and third magnet 62 pass through the neutral axis N between the first and second magnets 52 and 54.

FIG. 3A schematically illustrates one possible arrangement of the magnets 52, 54, and 62 poles used to generate the magnetic repulsion of the third magnet 62 from the first and second magnets 52 and 54. The arrangement disposes the north pole of the first magnet 52 adjacent the north pole of the third magnet 62 and the south pole of the second magnet 54 adjacent the south pole of the third magnet 62. This arrangement generates the magnetic repulsion that deflects and holds the beam 60 because the magnets 52, 54, and 62 are dipolar and the first pole of the third magnet 62 has the same polarity as the adjacent-most pole of the first magnet 52 and the second pole of the third magnet 62 has the same polarity as the adjacent-most pole of the second magnet 54.

Figure 3B:
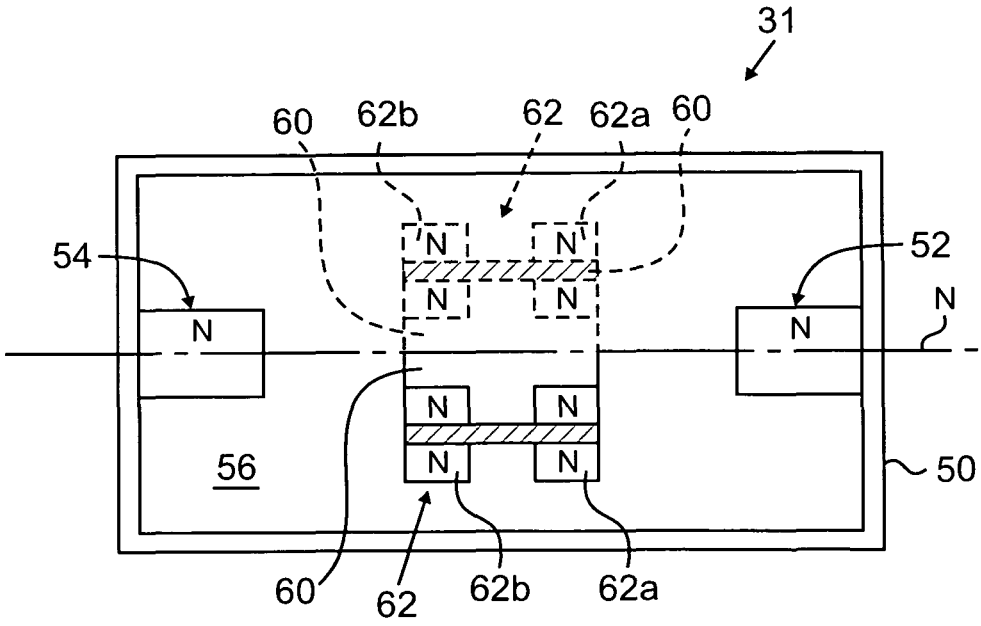
FIG. 3B is a schematic end view of another embodiment of the magnets used in the actuator.

FIG. 3B schematically illustrates another possible arrangement of the magnets 52, 54, and 62 poles used to generate the magnetic repulsion of the third magnet 62 from the first and second magnets 52 and 54. In FIG. 3B, the third magnet 62 is comprised of two magnets, a fourth magnet 62*a* mounted to the beam 60 adjacent the first magnet 52 and a fifth magnet 62*b* mounted to the beam 60 adjacent the second magnet 54. The magnets 52, 54, 62*a*, and 62*b* are oriented such that they extend longitudinally into the frame 50, therefore, only the north poles of each magnet are visible to the observer. The arrangement shown generates magnetic repulsion that deflects and holds the beam 60 because the magnets 52, 54, 62*a* and 62*b* are oriented such that the first pole (north pole in this embodiment) of the fourth magnet 62*a* has the same polarity as the adjacent most pole (north pole in this instance) of the first magnet 52 and the first pole (north pole in this instance) of the fifth magnet 62*b* has the same polarity as the adjacent most pole (north pole in this instance) of the second magnet 54.

Figure 4:
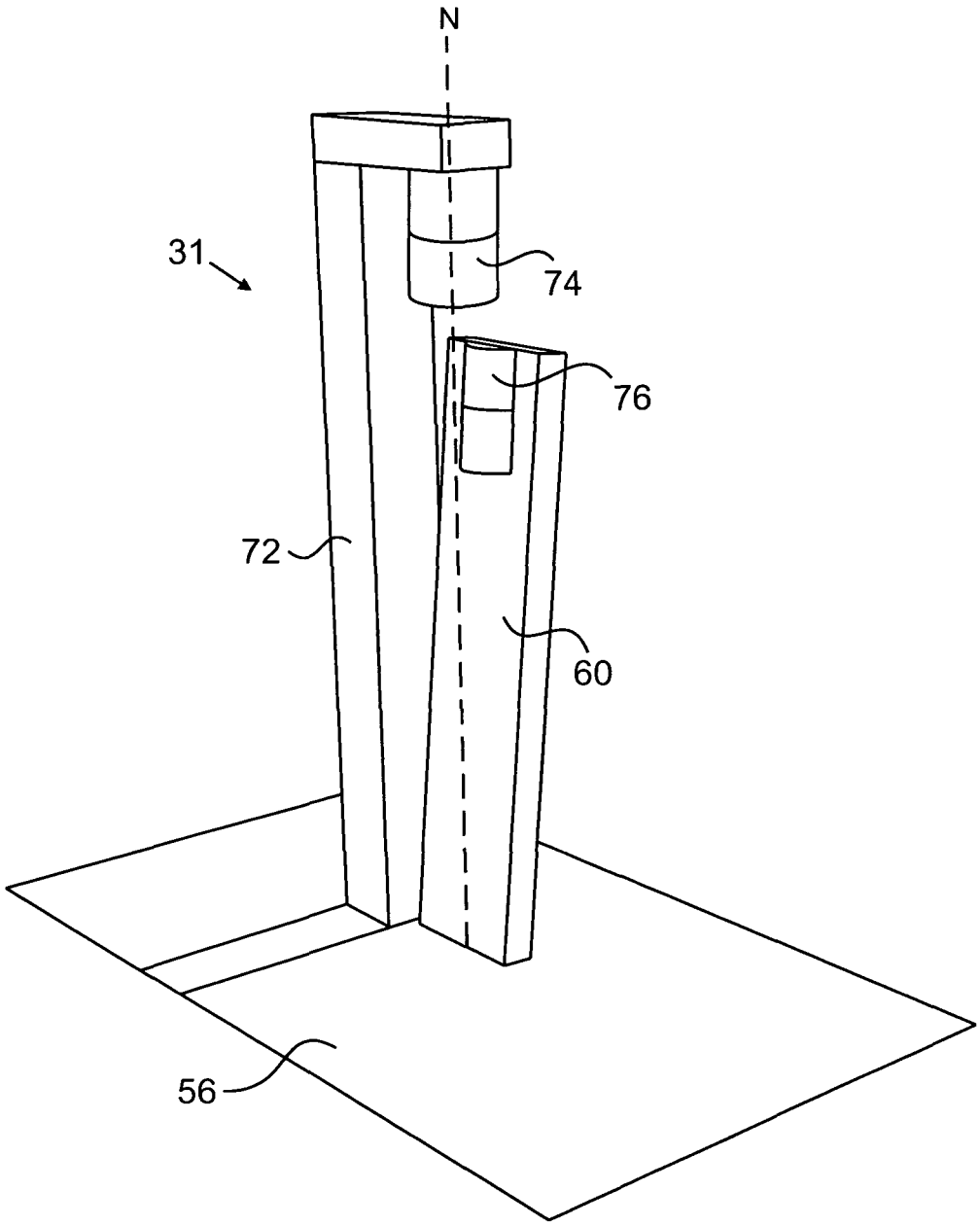
FIG. 4 is a perspective view of another embodiment of the actuator.

FIG. 4 shows another arrangement of the actuator 31 in either the first position or the second position. The actuator 31 includes a stationary member 72 which extends from the mounting plate 56. The actuator 31 also includes a first magnet 74 and a second magnet 76 in addition to the beam 60.

The member 72 extends from the mounting plate 56 to cantilever over the neutral axis N of the beam 60. The first stationary magnet 74 connects to the member 72 and has poles which are co-aligned with the neutral axis N. The beam 60 movably extends from the mounting plate 56. The second magnet 76 is connected to the end portion of the beam 60 adjacent the cantilevered portion of the member 72 and first magnet 74. The poles of the second magnet 76 are arranged to generate magnetic repulsion of the second magnet 76 from the first stationary magnet 74. For example, the arrangement of the magnets 74 and 76 disposes the north pole of the first magnet 74 adjacent the north pole of the second magnet 76. This arrangement generates the magnetic repulsion that deflects and holds the beam 60 in the first and second position.

Additional magnet arrangements that result in magnetic repulsion deflecting and maintaining a beam in desired position(s) are within the spirit and scope of the invention. Although the present invention has been described with reference to preferred embodiments, workers skilled in the art will recognize that changes may be made in form and detail without departing from the spirit and scope of the invention.

The invention claimed is:

1. An electronic door lock having a first unlocked position and a second locked position, comprising:

a bi-stable actuator, comprising:

a first magnet assembly comprising at least one magnet stationarily positioned within the electronic door lock;

a beam that moves relative to the first magnet assembly between the first unlocked position and the second locked position;

a second magnet assembly comprising at least one magnet connected to the beam, the second magnet assembly configured to be magnetically repulsed by and away from the first magnet assembly to maintain the beam in the first unlocked position and further configured to be magnetically repulsed by and away from the first magnet assembly to maintain the beam in the second locked position; and an electrical assembly for electrically moving the beam between the first unlocked position and the second locked position.

2. The electronic door lock of claim 1, wherein the second magnet assembly has a magnetic pole with a same polarity as the adjacent most magnetic pole of the first magnet assembly such that the second magnet assembly is magnetically repulsed by and away from the first magnet assembly thereby magnetically maintaining the beam in either the first unlocked position or the second locked position without the use of battery power.

3. The electronic door lock of claim 1, further comprising a frame having a first side and a second side opposite the first side, the first magnet assembly includes at least at least a first magnet disposed to the first side of the frame, a second magnet disposed to the second side of the frame, and a gap between the first magnet and the second magnet, wherein the beam is configured to be actuated by the electrical assembly through the gap between the first magnet and the second magnet to either the first unlocked position or the second locked position.

4. The electronic door lock of claim 1, further comprising a battery that supplies electrical current to the actuator only when the beam is actuated between the first unlocked position and the second locked position and does not supply electrical current to the beam when the beam is magnetically maintained in the first unlocked position or the second locked position.

5. The electronic door lock of claim 1, wherein the electrical assembly is a piezoelectric assembly and the beam is piezoelectrically actuated to overcome the magnetic repulsion of the second magnet assembly from the first magnet assembly to move the beam between the first unlocked position and the second locked position.

6. The electronic door lock of claim 1, wherein the electrical assembly is an electromagnetic assembly and the beam is electromagnetically actuated to overcome the magnetic repulsion of the second magnet assembly from the first magnet assembly to move the beam between the first unlocked position and the second locked position.

7. The electronic door lock of claim 1, wherein the electrical assembly is an electrostatic assembly and the beam is electrostatically actuated to overcome the magnetic repulsion of the second magnet assembly by the first magnet assembly to move the beam between the first unlocked position and the second locked position.

8. The electronic door lock of claim 7, wherein a polarity of an electric field generated by the electrostatic assembly can be switched back and forth to move the beam back and forth between the first unlocked position and the second locked position.

9. The electronic door lock of claim 1, further comprising a clutch that is engaged by and held in an unlocked position by the beam when the beam is in the first unlocked position.

10. The electronic door lock of claim 1, further comprising a latch that is disengaged by and held in an unlocked position by the beam when the beam is in the first unlocked position.

11. An electronic door lock comprising a bi-stable actuator, the electronic door lock comprising a handle shaft selectively rotating independently of a lock shaft and further comprising:

a stationary door lock housing;

a first magnet assembly fixedly connected to the housing within the electronic door lock;

a beam movably disposed in the housing and capable of being electrically actuated relative to the first magnet assembly to a first unlocked position and a second locked position; and a second magnet assembly connected to the beam and configured to be magnetically repulsed by and away from the first magnet assembly to maintain the beam in the first unlocked position and further configured to be magnetically repulsed by and away from the first magnet assembly to maintain the beam in the second locked position;

an electrical assembly for electrically moving the beam between the first unlocked position and the second locked position; and a mechanism connected to the beam and movable thereby such that when the beam is in the first unlocked position the mechanism transmits rotation between the handle shaft and the lock shaft allowing the electronic door lock to be unlocked.

12. The electronic door lock of claim 11, further comprising a frame having a first side and a second side opposite the first side, the first magnet assembly includes at least at least a first magnet disposed to the first side of the frame, a second magnet disposed to the second side of the frame, and a gap between the first magnet and the second magnet, wherein the beam is configured to be actuated by the electrical assembly through the gap between the first magnet and the second magnet to either the first unlocked position or the second locked position.

13. The electronic door lock of claim 12, further comprising a battery that supplies electrical current to the actuator only when the beam is actuated between the first unlocked position and the second locked position and does not supply electrical current to the beam when the beam is magnetically maintained in the first unlocked position or the second locked position.

14. The electronic door lock of claim 11, wherein the moving of the beam overcomes the magnetic repulsion of the second magnet assembly from the first magnet assembly to move the beam between the first unlocked position and the second locked position.

15. The electronic door lock of claim 11, wherein the mechanism is a clutch that is engaged by and held in the first unlocked position by the beam when the electronic door lock is in the first unlocked position.

16. An electronic door lock, comprising:

a rotatable door handle;

a handle shaft operably connected to the door handle and capable of being rotationally actuated thereby;

a latch mechanism;

a lock shaft axially co-aligned with and rotatably mounted adjacent the handle shaft and rotatably connected to the latch mechanism;

a movable clutch capable of coupling the lock shaft with the handle shaft to unlock the latch mechanism;

an actuator comprising a movable beam and a stationary first magnet mounted therein, the moveable beam comprising a second magnet assembly mounted thereon which is configured to be magnetically repulsed by and away from the first magnet assembly to maintain the beam in a first unlocked position and further configured to be magnetically repulsed by and away from the first magnet assembly to maintain the beam in a second locked position; and an electrical assembly for electrically moving the beam between the first unlocked position and the second locked position wherein, when the electrical assembly moves the beam into the first unlocked position, the beam is configured to engage the clutch and couple the lock shaft with the handle shaft thereby unlocking the latch mechanism.

17. The electronic door lock of claim 16 wherein, in the second locked position, the actuator allows the clutch to decouple from the lock shaft and the handle shaft thereby locking the latch mechanism.

18. The electronic door lock of claim 16, wherein the first magnet assembly comprises a first magnet disposed at a first side of the beam, a second magnet disposed at a second side of the beam opposite the first side, and a gap between the first magnet and the second magnet, wherein the beam is configured to be actuated by the electrical assembly through the gap between the first magnet and the second magnet to either the first unlocked position or the second locked position.

19. The electronic door lock of claim 16, further comprising a battery which supplies electrical current to the actuator only when the beam is moved between the first unlocked position and the second locked position and does not supply electrical current to the beam when the beam is in the first unlocked position or the second locked position.

20. The electronic door lock of claim 16, wherein the electrical assembly is a piezoelectric assembly and the beam is piezoelectrically actuated to overcome the magnetic repulsion of the second magnet assembly from the first magnet assembly to move the beam between the first unlocked position and the second locked position.

21. The electronic door lock of claim 16, wherein the electrical assembly is an electromagnetic assembly and the beam is electromagnetically actuated to overcome the magnetic repulsion of the second magnet assembly from the first magnet assembly to move the beam between the first unlocked position and the second locked position.

22. The electronic door lock of claim 16, wherein the electrical assembly is an electrostatic assembly and the beam is electrostatically actuated to overcome the magnetic repulsion of the second magnet assembly by the first magnet assembly to move the beam between the first unlocked position and the second locked position.

* * * * *